US006390714B1

(12) United States Patent
Bradley et al.

(10) Patent No.: US 6,390,714 B1
(45) Date of Patent: May 21, 2002

(54) CUSTOMIZABLE ALBUM LEAVES WITH CHANGEABLE BACKGROUNDS

(76) Inventors: Gail S. Bradley, 4105 Colorado St., Long Beach, CA (US) 90814; Norman Yamamoto, 5460 Running Spring Way, Yorba Linda, CA (US) 92887; Earl A. Vito, 4091 Denver Ave., Yorba Linda, CA (US) 92886

( * ) Notice: Subject to any disclaimer, the term of this patent is extended or adjusted under 35 U.S.C. 154(b) by 0 days.

(21) Appl. No.: 09/558,026

(22) Filed: Apr. 25, 2000

(51) Int. Cl.[7] ..... B42F 13/00

(52) U.S. Cl. ..... 402/79; 40/124.06; 40/700; 281/38; 402/70; 402/80 P; 402/80 R; D19/26; D19/33

(58) Field of Search ..... 402/80 P, 79, 402/80 R, 70; 206/455, 456, 316.1; 281/38; 40/124.06, 700, 701, 704, 724, 732, 768, 771, 772, 775, 776; D19/26, 27, 32, 33

(56) References Cited

U.S. PATENT DOCUMENTS

| | | | | | |
|---|---|---|---|---|---|
| 1,583,381 | A | * | 5/1926 | Zimmerman | |
| 2,505,506 | A | * | 4/1950 | Sayre | 129/20 |
| 2,677,910 | A | * | 5/1954 | Morgan | 40/158 |
| 2,736,976 | A | * | 3/1956 | Richthamer | 40/158 |
| 2,844,900 | A | * | 7/1958 | Miller | 40/158 |
| 2,963,809 | A | * | 12/1960 | Parker | 40/158 |
| 3,336,845 | A | * | 8/1967 | Lepisto et al. | |
| 3,435,868 | A | * | 4/1969 | Stermer | |
| 3,464,135 | A | * | 9/1969 | Eldinger | 40/159 |
| 3,642,552 | A | * | 2/1972 | Sibley | 156/108 |
| 3,751,839 | A | * | 8/1973 | Mitchell | 40/158 |
| 3,797,146 | A | * | 3/1974 | Holes | 40/8 |
| 3,827,552 | A | * | 8/1974 | Janhonen | 206/424 |
| 4,140,565 | A | * | 2/1979 | Paerker et al. | 156/219 |
| 4,244,762 | A | | 1/1981 | Holson | |
| 4,447,973 | A | * | 5/1984 | Wihlke | 40/159 |
| 4,516,871 | A | | 5/1985 | Leitman | |
| 4,771,557 | A | | 9/1988 | Bowman | |
| 4,784,508 | A | | 11/1988 | Shannon | |
| 4,824,273 | A | * | 4/1989 | Silva et al. | 402/79 |
| 4,907,904 | A | | 3/1990 | Baldwin | |

(List continued on next page.)

OTHER PUBLICATIONS

Disk & Document Sheet Protectors, Model No. DDS11–3–CR, 72641, Avery Dennison Corporation.

*Primary Examiner*—Willmon Fridie, Jr.
*Assistant Examiner*—Monica Carter
(74) *Attorney, Agent, or Firm*—Eric K. Satermo

(57) ABSTRACT

A customizable leaf for retaining visual material includes a first assembly and a second assembly. Each of the assemblies includes a front sheet and a back sheet attached together to form a margin and an accessible pocket. The sheets are made from an optically transparent material such as polypropylene. The sleeve is adapted to receive a background that may include graphics. The background is visible in the margins when received within the sleeve. One or more backgrounds may be provided, each with graphics, so that a user may select one of the backgrounds and then insert the selected background into the sleeve. When visual material such as a photograph is then inserted into one of the pockets, the background, particularly the graphics, is visible at the margins. The leaf is particularly suitable for albums, such photo albums, scrap books, card-collecting albums, and so on. The leaf may include a binding portion to enable easy binding in, for example, a standard three-ring, strap-bound, or post-bound binder to form such albums.

16 Claims, 6 Drawing Sheets

U.S. PATENT DOCUMENTS 4,991,336 A * 2/1991 Lucke ..... 40/630
5,114,009 A * 5/1992 Johnston ..... 206/425
5,294,279 A * 3/1994 Kuhns et al. ..... 156/324.4
5,316,404 A * 5/1994 Hensel ..... 402/79
5,371,963 A * 12/1994 Gallagher ..... 40/158.1
5,375,936 A 12/1994 Jennison et al.
5,546,685 A * 8/1996 Gallagher ..... 40/768
5,876,145 A 3/1999 Datum
6,012,866 A 1/2000 Podosek
D421,051 S * 2/2000 Jahn ..... D19/33
6,019,539 A 2/2000 Lynton
6,056,494 A * 5/2000 Fong et al. ..... 412/37
6,062,387 A * 5/2000 Chen ..... 206/455
6,086,106 A * 7/2000 Joe et al. ..... 281/31

* cited by examiner

CUSTOMIZABLE ALBUM LEAVES WITH CHANGEABLE BACKGROUNDS

BACKGROUND OF THE INVENTION

1. Field of the Invention

The present invention relates to devices for retaining visual material, such as sheet protectors for retaining documents or photo album leaves for retaining photographs. More particularly, the present invention relates to such devices that allow the visual material to be presented upon desired backgrounds for aesthetically enhanced presentation.

2. Description of the Related Art

Sheet protectors are devices that have one or more plastic sleeves in which sheet material such as photographs or documents may be inserted and viewed. Sheet protectors are manufactured for a number of consumer markets. For example, there are sheet protectors that are configured as leaves for photo albums. There are also sheet protectors for receiving a single sheet of paper, as well as multiple visual material such as trading cards (e.g., baseball cards).

Sheet protectors are commonly made from sheets of polyolefin, such as polypropylene or polyethylene, or from sheets of polyvinyl chloride. Polypropylene sheets have certain advantages over vinyl as a sheet material for fabricating sheet protectors. For example, polypropylene is substantially chemically inert and will generally not react with dyes and other surface components of photographs and printed material such as trading cards. In addition, polypropylene is physically resistant to extreme heat and cold. Accordingly, polypropylene is highly suitable for archival or long-term storage of visual material.

While highly advantageous for use in fabricating sheet protectors and album leaves, polypropylene does not necessarily inherently provide the user with a wide array of aesthetically pleasing presentation techniques. More specifically, polypropylene is optically transparent and, therefore, offers little by way of visually enhancing the presentation of the material retained thereby. In addition, polypropylene does not readily allow for marking with pens or markers. Accordingly, a user is unable to present the visual material in a desired and personalized visual format.

In view of the foregoing, there remains a need in the art for sheet protectors and album leaves that enable a user to enhance and customize the presentation of visual material.

BRIEF SUMMARY OF THE INVENTION

According to one aspect of the invention, a customizable leaf for retaining visual material includes a first assembly and a second assembly. Each of the assemblies includes a front sheet and a back sheet attached together to form a margin and an accessible pocket. The sheets are preferably made from an optically transparent material such as a thermoplastic. A sleeve is defined between the back sheets of the assemblies. The sleeve is adapted to receive a background that may include text and/or graphics. The background is visible in the margins when received within the sleeve. The accessible pocket is adapted to receive visual material.

The present invention has a number of advantages over conventional album leaves, one of which is the customizable nature of the leaf. For example, one or more backgrounds may be provided, each with text and/or graphics, so that a user may select one of the backgrounds and then insert the selected background into the sleeve. When visual material such as a photograph is then inserted into one of the pockets, the background is visible at the margins. Accordingly, the background provides an aesthetic visible field upon which the photograph is presented. Because of the slidably receivable nature of the sleeve, the user may replace the background with another background having different graphics as desired. Alternatively, the user may customize his or her own background and then insert the same into the sleeve. The sleeve may be configured to retain a pair of backgrounds so that a first side of the leaf may have a background with one type of graphics, while a second side of the leaf may have a background with another type of graphics.

The leaf of the present invention is particularly suitable for albums and binders, either photo albums, scrap books, card-collecting albums, memory books, etc. In a photo album embodiment, each of the assemblies of the leaf may include a plurality of pockets, for example, one or more pockets configured to receive photographs. The leaf may also include a binding portion to enable easy binding by conventional binder structure, for example, a three-ring binder, a post-bound binder, a strap-bound binder, and so on. In addition to photographs, the pockets may be configured to retain other visual sheet material such as trading cards (e.g., baseball cards), mementos for scrap books or memory books, and so on.

Rather than retaining visual sheet material, the leaves may be configured with pockets for retaining storage media such as floppy disks, compact disks, CD-ROMs, DVDs, memory cards, magnetic tapes, etc. In this useful embodiment of the invention, the sleeve may receive documentation associated with the storage medium retained in the pocket (or pockets).

According to another aspect of the invention, a leaf for retaining visual material includes a first sheet made from optically transparent material and a background attached to the front sheet to form a margin and an accessible pocket for receiving visual material. The background is visible in the margin when visual material is received within the pocket. Rather than being removable, the background in this embodiment is permanently disposed within the leaf.

Any and all of the features described herein and combinations of such features are included within the scope of the present invention provided that the features of any such combination are not mutually inconsistent.

Additional aspects, features, and advantages of the present invention will become apparent to those skilled in the art from a consideration of the following detailed description taken in conjunction with the accompanying drawings.

DETAILED DESCRIPTION OF THE INVENTION

Figure 1:
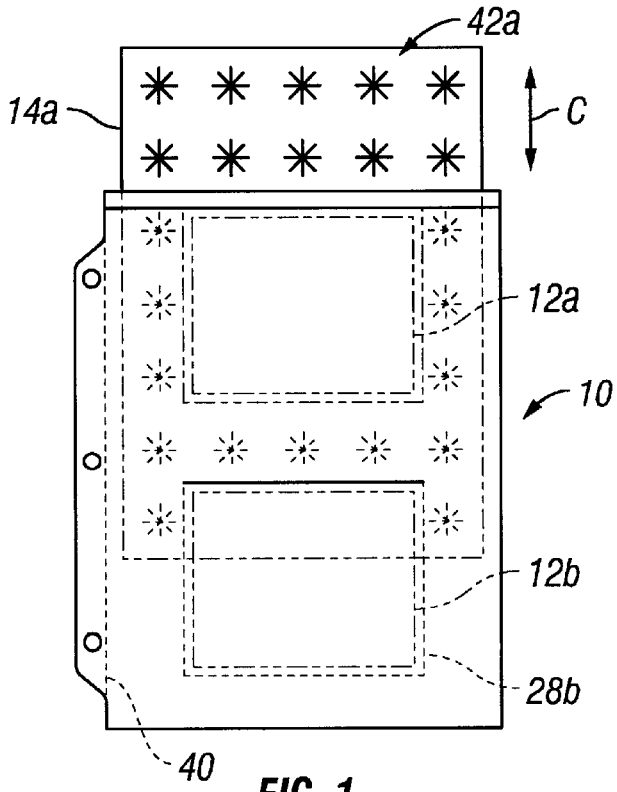
FIG. 1 is a schematic plan view of a leaf with changeable backgrounds in accordance with an exemplary embodiment of the invention, particularly illustrating the slidably receivable nature of a sleeve of the leaf.

Referring more particularly to the drawings, an album or binder leaf with a background is shown according to an exemplary embodiment of the invention and is indicated generally with reference numeral 10. In accordance with the principles of the present invention, the leaf 10 may be configured in any number of embodiments, each of which enables a user to display visual material in a customized, creative, and aesthetic manner. The word "leaf" is used herein in accordance with conventional book-binding vernacular as an element of a book, a binder, or an album containing two pages, i.e., a front and a back. For example, in many useful embodiments of the invention, the leaf 10 functions analogously to a photo page for a photo album. The leaf 10 may be configured to be permanently bound in a binder or an album or, alternatively, releasably bound such as with a three-ring binder, which will be described in detail below.

Figure 2:
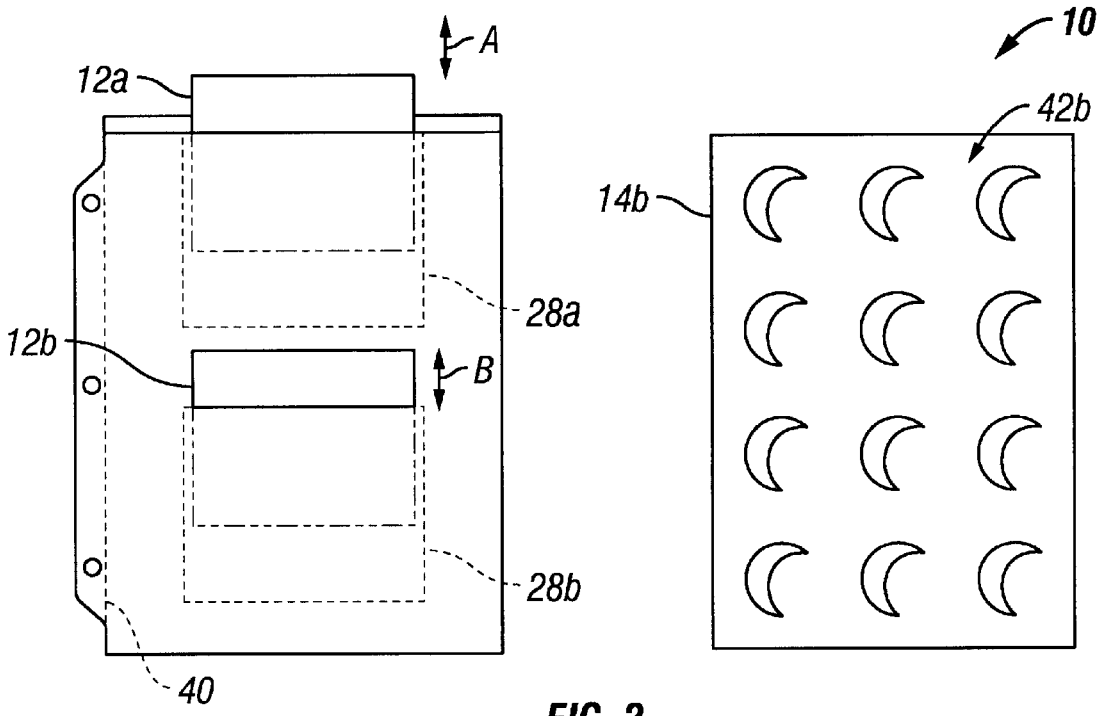
FIG. 2 is a schematic plan view of the leaf of FIG. 1 illustrated with a background removed therefrom.

As shown in the embodiment of FIGS. 1 and 2, exemplary leaf 10 may be configured to retain one or more photographs 12*a* and 12*b* with a background 14*a* spatially disposed behind the photographs 12. The photographs 12*a* and 12*b* may be inserted into and out of the leaf 10 as indicated by arrows A and B, respectively. Similarly, in accordance with a preferred embodiment of the invention, the background 14*a* may be inserted into and out of the leaf 10 as indicated by arrow C, thereby allowing the replacement by another background 14*b* having a different design than sheet 12*a,* if desired. Accordingly, the leaf 10 configured in accordance with the principles of the present invention enables a user to create a customized album 16 including a plurality of leaves 10*a,* 10*b,* 10*c,* . . . , 10*n* each displaying visual material accordingly to his or her own aesthetic sensibilities.

Prior to describing the present invention in more detail, a convention for the use of reference numbers for the purposes of this description is provided. A single reference numeral (i.e., 10) is used to indicate the leaf in each of the numerous exemplary embodiments shown in the drawings and described herein. In addition, generic elements of the leaf 10 are indicated generally by a reference numeral, e.g., the background 14, and specifically by the reference numeral with an alpha suffix, e.g., backgrounds 14*a* and 14*b*. In addition, for the sake of clarity in the drawings, certain elements are shown in phantom line, for example, the photos 12 and the portion of the background 14 received by the leaf 10 in FIG. 1. Also in connection with the drawings, the description of the leaf 10 will be described in accordance with Cartesian coordinates, with a transverse axis T corresponding to the x axis, a longitudinal axis L corresponding to the y axis, and a normal axis N corresponding to the z axis.

Figure 4:
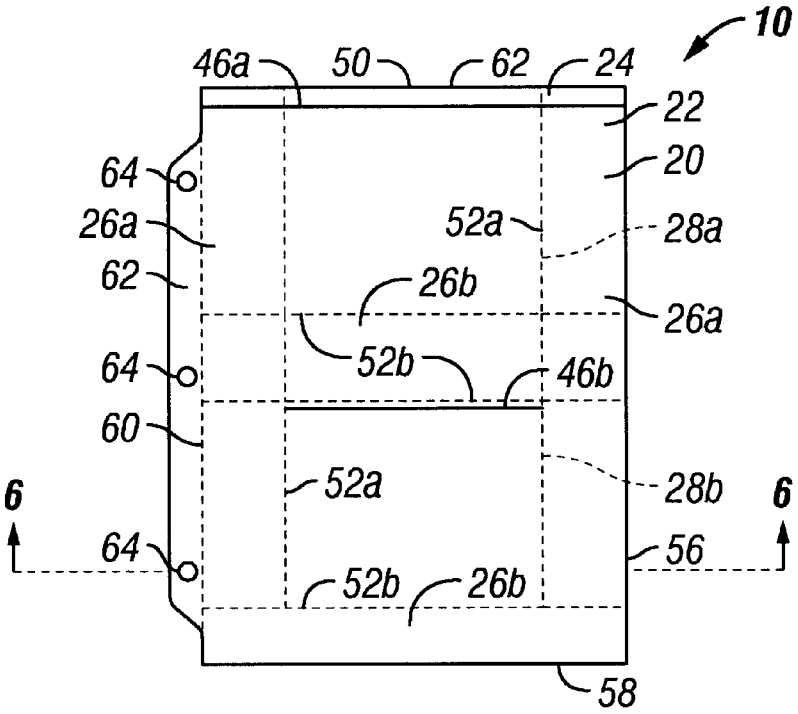
FIG. 4 is a schematic plan view of front side of the leaf of the present invention.
Figure 5:
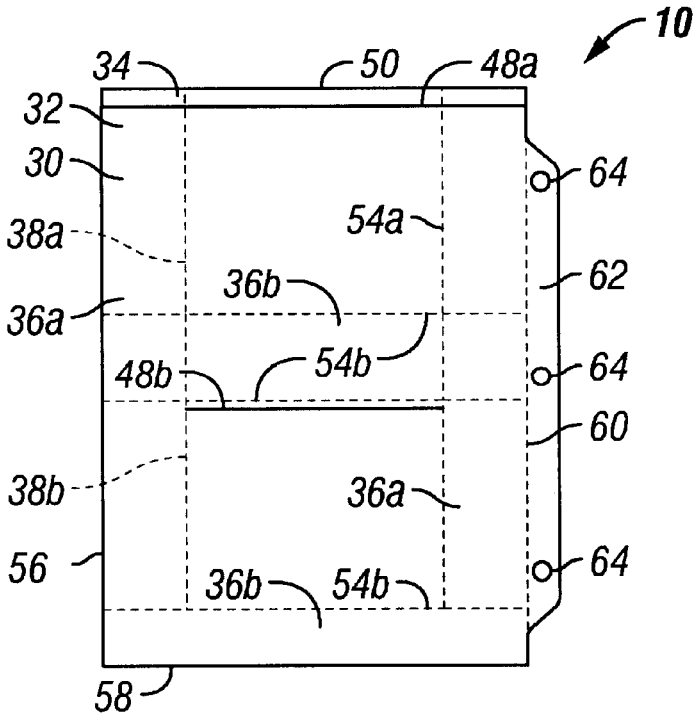
FIG. 5 is a schematic plan view of a back side of the leaf of the present invention.
Figure 6:
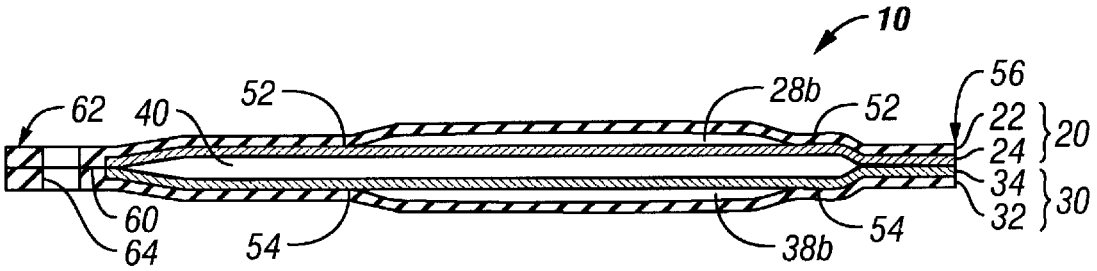
FIG. 6 is an enlarged cross-sectional view of a leaf of the invention, taken alone line 6—6 of FIG. 4.

With additional reference to FIGS. 4, 5, and 6, exemplary leaf 10 generally includes a first assembly 20 including a front sheet 22 and a back sheet 24 attached together to form a margin 26 and an accessible pocket 28, and a second assembly 30 including a front sheet 32 and a back sheet 34 attached together to form a margin 36 and an accessible pocket 38. The assemblies 20 and 30 are attached together to form a sleeve 40 between the back sheets 24 and 34. The sleeve 40 is configured to slidably receive one or more of the backgrounds 14 therein. For the purposes of clarity, the dimensions of the leaf 10 shown in the cross section of FIG. 6 are greatly exaggerated.

The sheets 22, 24, 32, and 34 are made from visually transparent material such as polypropylene, as known in the art. When received within the sleeve 40, the background 14 is, therefore, visible through the sheets in the margins 26 and 36. In addition, any items received within the pockets 28 and 38 are also visible through the front sheets 22 and 32, respectively.

As shown in FIGS. 1 and 2, the present invention may be commercialized to provide a plurality of preprinted backgrounds 14 each with graphics 42. For example, backgrounds 14*a* and 14*b* are illustrated with stellar and lunar graphics 42*a* and 42*b,* respectively. Alternatively, the background 14 may be blank or free of design to allow a user to create a custom design on the background. For example, legends corresponding to the photographs 12 retained in the pockets 28 and 38 may be written upon the backgrounds 14 at appropriate locations to be visible at the margins 26 and 36. Alternatively, the sleeve 40 may be configured to receive standard 8½ by 11-inch paper, so that a user can create customized backgrounds, either free hand or on a computer, and insert the customized backgrounds in the sleeve.

The background 14 may be printed with graphics 42 on each side thereof. Alternatively, if graphics are printed on only one side of the background 14, then a pair of backgrounds 14 may be received in the sleeve 40 at one time so that graphics are visible through the front sheets of both assemblies 20 and 30.

Each of the assemblies 20 and 30 may include any number and configuration of pockets 28 and 38, respectively. For example, a commercially produced leaf 10 configured to be retained in a standard three-ring binder 44 as shown in FIG. 2 may have dimensions analogous to those of standard paper, i.e., about 8 or 9 inches transversely by about 11 or 12 inches longitudinally. Accordingly, if the leaf 10 is intended to hold photographs of standard size, i.e., 3 inches by 5 inches or 4 inches by 6 inches, then each of the assemblies 20 and 30 may include a pair of pockets 28 and 38, respectively, with each of the pockets having dimensions slightly greater than those of the photographs. If the leaf 10 is intended to hold sports cards, then each of the assemblies 20 and 30 may include six pockets or nine pockets 28 and 38, depending upon the desired configuration.

Each of the pockets 28 of the first assembly 20 includes a slit 46, and each of the pockets of the second assembly 30 includes a slit 48. The slits 46 and 48 provide access to the pockets 28 and 38, respectively, thereby allowing material to be inserted into and removed from the pockets. The slits 46*a* and 48*a* of upper pockets 28*a* and 38*a* may be formed by not attaching the first sheets 22 and 32 to the second sheets 24 and 34, respectively, along top edges 50 thereof. In addition, the slits 46*b* and 48*b* of lower pockets 28*b* and 38*b* may be formed by cutting through the front sheets 22 and 32, respectively.

The front sheets 22 and 32 are attached to the back sheets 24 and 34, respectively, to form the assemblies 20 and 30 in accordance with the present invention. The method for attaching the sheets together may be accomplished according to any number of methods as known in the art, for example, by heat or thermo-contact welding, radio-frequency (RF) welding, adhesive, and so on. With particular reference to FIG. 4, the front sheet 22 may be attached to the back sheet 24 to form seams 52 which define the margins 26 and the pockets 28 of the first assembly 20. Similarly, with particular reference to FIG. 5, the front sheet 32 may be attached to the back sheet 34 to form seams 54 which define the margins 36 and the pockets 38 of the second assembly 30. The seams 52 and 54 are shown by dashed lines in the drawings. As shown in the exemplary embodiment of FIG. 4, the margin-defining seams 52 include longitudinal seams 52*a* and transverse seams 52*b*, thereby defining longitudinal margins 26*a* and 36*a* and transverse margins 26*b* and 36*b*.

In addition the seams 52 and 54 to form the margins and the pockets, the first assembly 20 is attached to the second assembly 30 to form the sleeve 40. The attachment of the assemblies 20 and 30 is preferably along an outer edge 56, a bottom edge 58, and an inner longitudinal seam 60. The top edges 50 of the assemblies 20 and 30 are not attached together, thereby defining a slit 62 for the sleeve 40. In many commercial embodiments of the leaf 10, the sleeve 40 may have dimensions of at least about 8 inches transversely by at least about 10½ inches longitudinally so that the sleeve is able to receive one or more sheets of standard 8½ by 11-inch paper.

Figure 3:
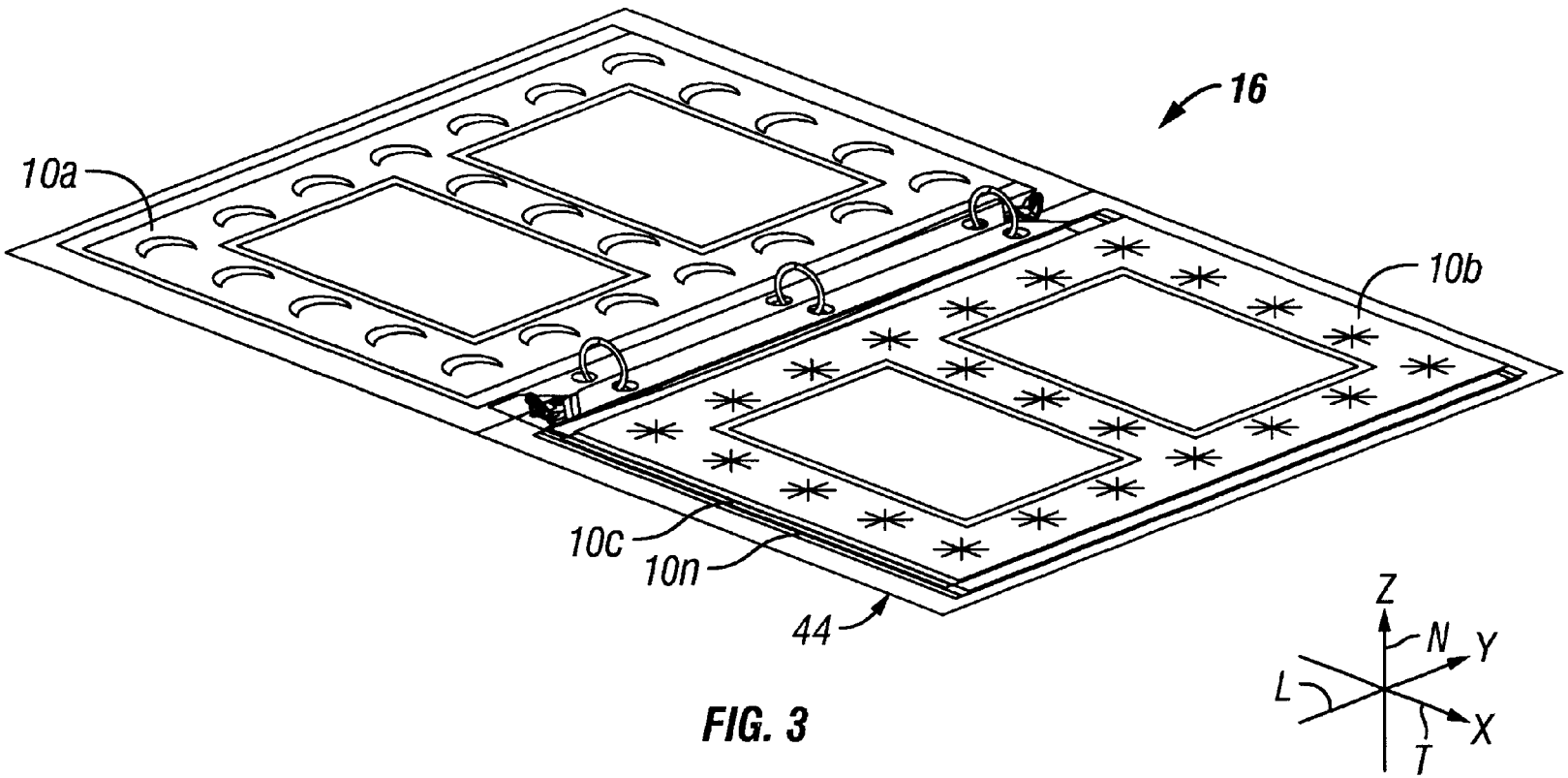
FIG. 3 is a perspective view of an album with a plurality of customizable leaves in accordance with the present invention.

In addition to forming the sleeve 40, the inner seam 60 defines a binding portion 62 of the leaf 10. The binding portion 62 may include a plurality of spaced through holes 64 for engaging with a binding structure 66 of the binder 44 as shown in FIG. 3. As known in the art, the binding structure 66 of a standard ring binder 44 include three rings spaced apart at about 4¼ inches on center. Alternatively, the binding portion 62 may be configured for engaging with a binder or album incorporating a post binder or a strap hinge, both of which are known in the art. The binding portion 62 may be configured to permanently bind the leaves 10 in an album if desired.

Figure 7:
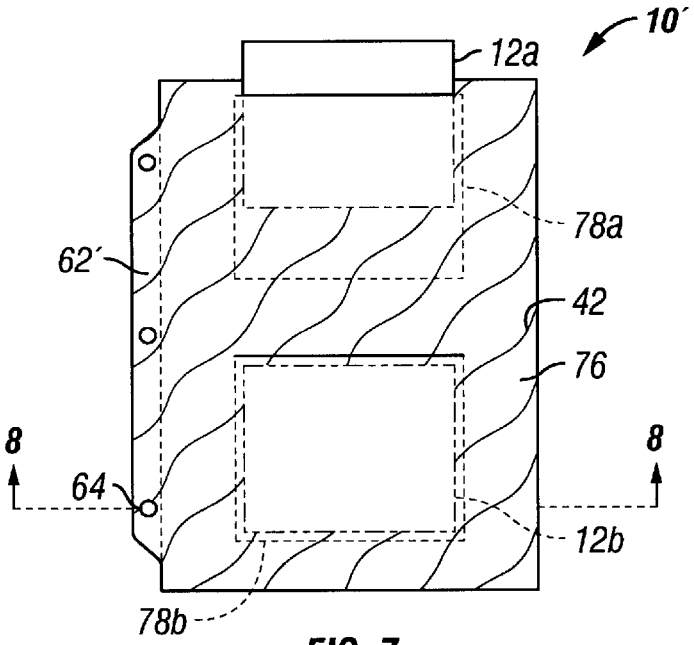
FIG. 7 is a schematic plan view of a leaf in accordance with another exemplary embodiment of the invention.
Figure 8:
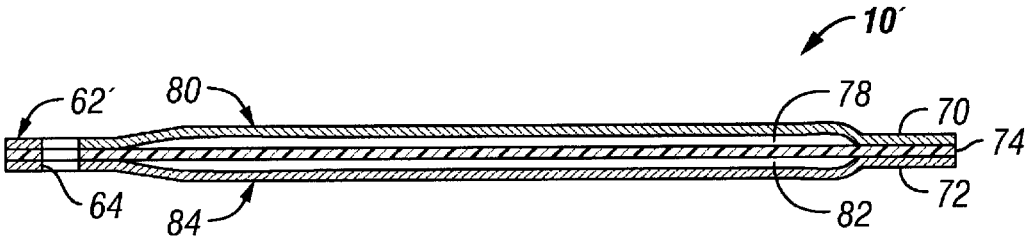
FIG. 8 is an enlarged cross-sectional view of a leaf of the invention, taken alone line 8—8 of FIG. 7.

An alternative embodiment of the leaf of the present invention is shown in FIGS. 7 and 8 and is indicated by reference numeral 10'. Exemplary leaf 10' includes a first sheet 70 and a second sheet 72 with a background 74 disposed therebetween. The first sheet 70 is attached to the background 74 to define a margin 76 about one or more pockets 78 on a front side 80 of the leaf 10'. Similarly, the second sheet 72 is attached to the background 74 to define a margin (not shown) about one or more pockets 82 on a back side 84 of the leaf 10'. As shown in FIG. 8, the pockets 78 and 82 are defined between the first and second sheets 70 and 72 and the back ground sheet 74 and are configured to receive visual material such as photographs 12, analogous to that described above.

According to the present invention shown in FIGS. 7 and 8, the background 74 is substantially coextensive transversely and longitudinally with the first and second sheets 70 and 72. Accordingly, the background 74, along with any graphics 42 printed thereon, is visible not only at the margins but also at the binding portion 62' of the leaf 10'. In contrast to the removable background 14 of the leaf 10 shown in FIGS. 1–6, the background 74 of exemplary leaf 10' is not removable. However, a plurality of leaves 10' each with a background 74 having different graphics 42 may be made available to a consumer for selection.

Figure 9:
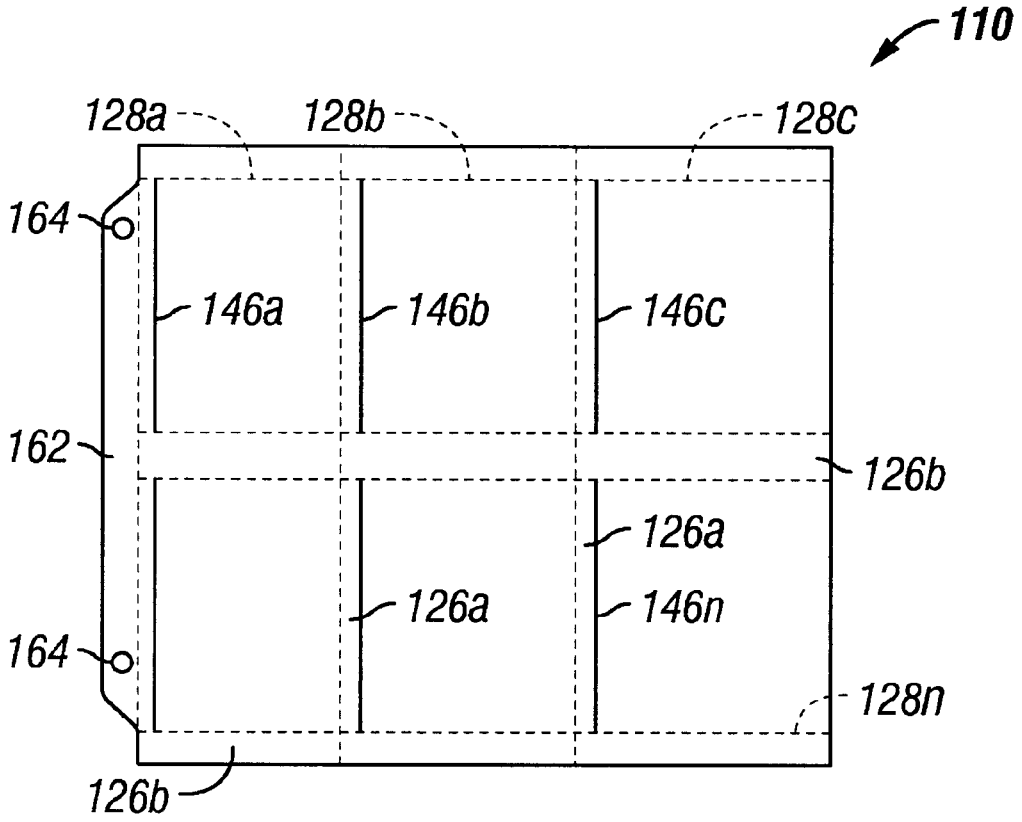
FIG. 9 is a schematic plan view of a leaf in accordance with yet another exemplary embodiment of the invention.

As mentioned above, the leaf of the present invention may be configured in any number of desired configurations, examples of which are shown in FIGS. 9, 10, 11, and 12. For the purposes of this description, analogous elements of the leaves shown in FIGS. 9–12 utilize the same two-digit reference numeral used above with the addition of a third digit; for example, leaf 110 of FIG. 9 is substantially equivalent to leaf 10. The description of like elements will not be repeated herein. Each of the leaves shown in FIGS. 9–12 may include a sleeve equivalent to sleeve 40 for receiving a background as shown in FIGS. 1–6 or, alternatively, may include a background as shown in FIGS. 7 and 8.

The leaf 110 of FIG. 9 includes a plurality of pockets 128*a*–128*n* interdisposed by a plurality of longitudinal and transverse margins 126*a* and 126*b*, respectively. Each of the pockets 128 has an access slit 146*a*–146*n*. The overall dimensions of exemplary leaf 110 may be equivalent to standard 12-inch-by-12-inch album leaves. Accordingly, the leaf 110 may include six pockets 128 each having dimensions of about 3 inches by 5 inches as shown. The leaf 110 includes a binding portion 162 which includes two holes 164 configured for post binding.

Figure 10:
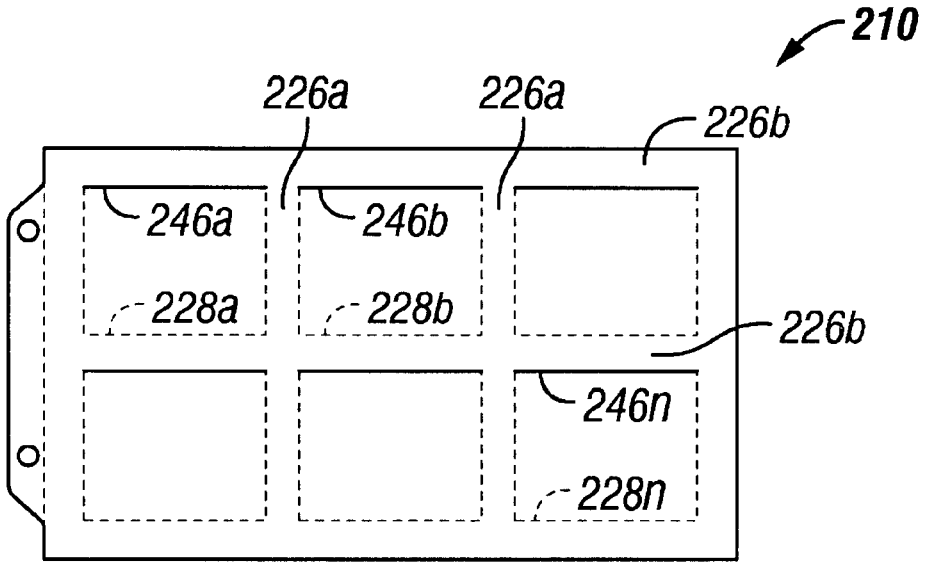
FIG. 10 is a schematic plan view of a leaf in accordance with still another exemplary embodiment of the invention.

Exemplary leaf 210 of FIG. 10 also includes a plurality of pockets 228 interdisposed by a plurality of longitudinal and transverse margins 126*a* and 126*b*, respectively. Each of the pockets 228 has an access slit 246. Exemplary leaf 210 may have a longitudinal dimension of about 8½ inches and a transverse dimension of about 14 inches.

Figure 11:
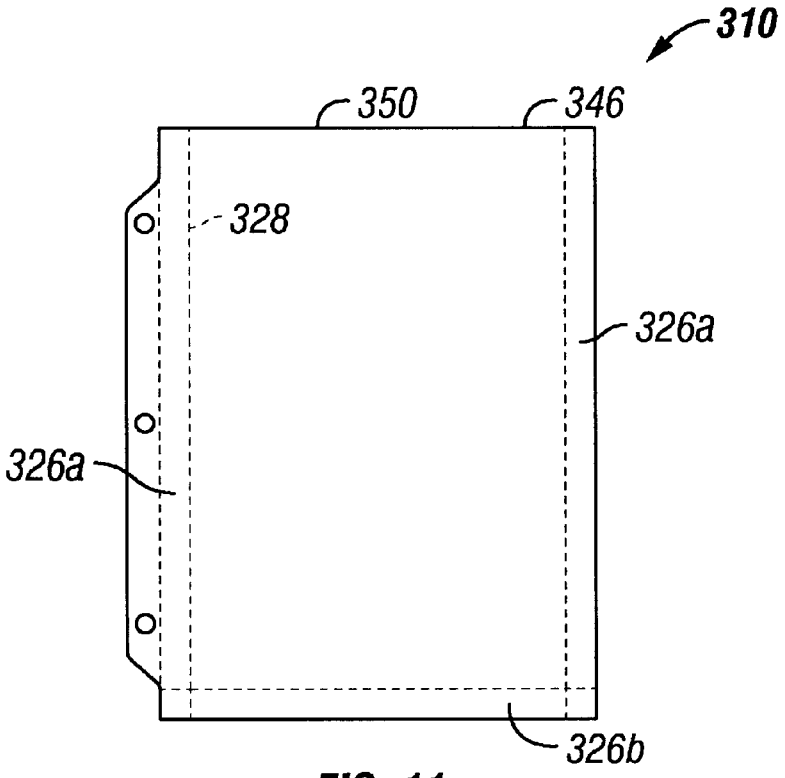
FIG. 11 is a schematic plan view of a leaf in accordance with a further exemplary embodiment of the invention.

Rather than including a plurality of pockets, exemplary leaf 310 shown in FIG. 11 includes a single pocket 328 bordered by longitudinal margins 326*a* and a transverse margin 326*b*. The pocket 328 has an access slit 346 that may be formed along a top edge 350 of the leaf. The pocket 328 may have dimensions suitable for receiving 8-inch-by-10-inch photographs.

Figure 12:
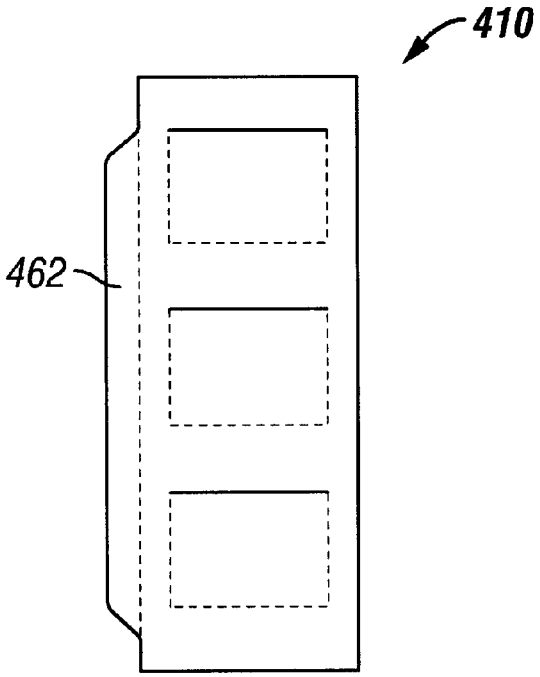
FIG. 12 is a schematic plan view of a leaf in accordance with a still further exemplary embodiment of the invention.

Exemplary leaf 410 shown in FIG. 12 includes a binding portion 462 that is free of holes but suitable for a strap hinge binding system. In addition, exemplary leaf 410 may have a longitudinal dimension of about 13 inches and a transverse dimension of about 7 inches.

The leaf 10 may be configured to hold in the pockets 28 and 38 storage media, such as CDs, CD-ROMs, DVDs, floppy disks, memory cards, magnetic tapes, or future electronic media, with the sleeve 40 holding documentation associated with the storage media. The leaf 10 may be configured to hold photographs of standard size, i.e., 3 inches by 5 inches, 4 inches by 6 inches, 5 inches by 7 inches, and 8 inches by 10 inches, as well as Polaroid®-type photographs, with the sleeve 40 holding negatives of the photographs in addition to a background. In addition, the leaf 10 may be configured to retain business cards, credit cards, stationery supplies, and any other item sized to be retained by the pockets.

Those skilled in the art will understand that the preceding exemplary embodiments of the present invention provide the foundation for numerous alternatives and modifications thereto. For example, the leaf 10 may be configured to hold trading cards, greeting cards, articles for a scrap book, clippings, and any other material that is desired to be displayed. In addition, text and/or graphics may be printed on the margins 26 and 36 or the front sheets 22 and 32. These and other modifications are also within the scope of the present invention. Accordingly, the present invention is not limited to that precisely as shown and described above but by the scope of the appended claims.

What is claimed is:

1. A leaf for retaining visual material, said leaf comprising:

a first assembly including a front sheet and a back sheet attached together to form a margin and an accessible pocket; and a second assembly including a front sheet and a back sheet attached together to form a margin and an accessible pocket, said assemblies being attached together to form a sleeve between said back sheets;

said sheets being made from an optically transparent material; and said sleeve for receiving a background so that the background is visible in said margin of each said assembly when received within said sleeve.

2. A leaf as claimed in claim 1 further comprising a background received within said sleeve;

said background being visible in said margin of each of said assembly.

3. A leaf as claimed in claim 1 wherein said background includes text or graphics.

4. A leaf as claimed in claim 1 wherein said assemblies are made from thermoplastic material.

5. A leaf as claimed in claim 1 wherein said front and back sheets of each said assembly are attached together to form a plurality of accessible pockets.

6. A leaf as claimed in claim 5 wherein said front sheet is attached to said back sheet of each said assembly by heat welding to form seams.

7. A leaf as claimed in claim 1 further comprising a binding portion configured to engage with a binder.

8. A leaf as claimed in claim 7 wherein said binding portion is configured to engage with a three-ring binder.

9. A leaf as claimed in claim 1 wherein at least one of said pockets has a height of at least about 4 inches and a width of at least about 6 inches.

10. A leaf as claimed in claim 1 wherein said sleeve has a width of at least about 8 inches and a height of at least about 10½ inches.

11. An album comprising:

a binder including binding structure;

a plurality of leaves, each said leaf including:

a first assembly including a front sheet and a back sheet attached together to form a margin and an accessible pocket; and a second assembly including a front sheet and a back sheet attached together to form a margin and an accessible pocket, said assemblies being attached together to form a sleeve between said back sheets and a binding portion configured to engage with said binding structure; and a plurality of backgrounds each configured to be receivable within said sleeves of said leaves, each said background being visible in said margin of each said assembly when received in one of said sleeves.

12. An album as claimed in claim 11 wherein at least one of said backgrounds is preprinted with text and/or graphics.

13. An album as claimed in claim 11 wherein each of said backgrounds includes graphics.

14. An album as claimed in claim 13 wherein said graphics of at least one of said backgrounds is different than said graphics of another one of said backgrounds.

15. A method for customizing an album, said method comprising:

providing an album including:

a binder including binding structure;

a plurality of leaves, each said leaf including:

a first assembly including a front sheet and a back sheet attached together to form a margin and an accessible pocket; and a second assembly including a front sheet and a back sheet attached together to form a margin and an accessible pocket, said assemblies being attached together to form a sleeve between said back sheets and a binding portion configured to engage with said binding structure; and a plurality of backgrounds each configured to be receivable within said sleeves of said leaves, each said background being visible in said margin of each said assembly when received in one of said sleeves; and inserting one of said backgrounds into said sleeve of one of said leaves.

16. A method as claimed in claim 15 further comprising the step of removing said background from said sleeve.

* * * * *